United States Patent [19]

Lever et al.

[11] Patent Number: 5,048,445

[45] Date of Patent: Sep. 17, 1991

[54] FLUID JET SYSTEM AND METHOD FOR UNDERWATER MAINTENANCE OF SHIP PERFORMANCE

[75] Inventors: Roland N. J. Lever, Jensen Beach; Ian E. Brown, Ft. Lauderdale, both of Fla.

[73] Assignee: Cavi-Tech, Inc., Fort Lauderdale, Fla.

[21] Appl. No.: 404,221

[22] Filed: Sep. 8, 1989

[51] Int. Cl.[5] ..... B63B 59/00

[52] U.S. Cl. ..... 114/222

[58] Field of Search ..... 15/1.7, 319, 320; 114/222

[56] References Cited

U.S. PATENT DOCUMENTS

| | | | |
|---|---|---|---|
| 4,149,345 | 4/1979 | Atsuchi | 51/424 |
| 4,163,455 | 8/1979 | Herbert | 134/167 R |
| 4,220,170 | 9/1980 | Herbert | 134/167 R |
| 4,809,383 | 3/1989 | Urakami | 15/97 |

FOREIGN PATENT DOCUMENTS 58-126285 7/1983 Japan .

*Primary Examiner*—Sherman Basinger

*Attorney, Agent, or Firm*—Cushman, Darby & Cushman

[57] ABSTRACT

A fluid jet system for underwater maintenance of a ship hull is provided. The fluid jet system includes an open frame cart having a high pressure fluid nozzle manifold for cleaning and smoothing the submerged hull of the ship. One or more thruster assemblies are provided on the cart for deploying the cart through the water, advancing the cart along the hull and maintaining the cart in contact with the hull. Control of the thruster assembly and fluid flow manifold can be effected from either longitudinal end of the cart. Flexible fluid flow lines interconnect the cart to one or more remote sources of pressurized fluid so that the cart is independently operable. A system for deploying the cart is further provided and includes the necessary high pressure pumps, devices for hose deployment and retrieval, and diver supplies. Finally, a system of underwater maintenance of ship performance is provided whereby the condition of the hull of the ship is monitored and areas to be cleaned and smoothed are determined in order of priority based upon projected improvement to ship performance.

38 Claims, 13 Drawing Sheets

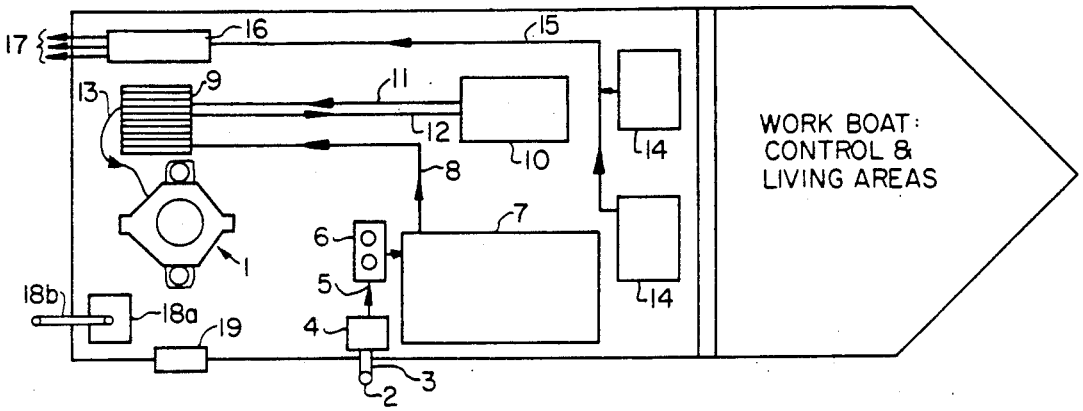
FIG. 1
FIG. 4
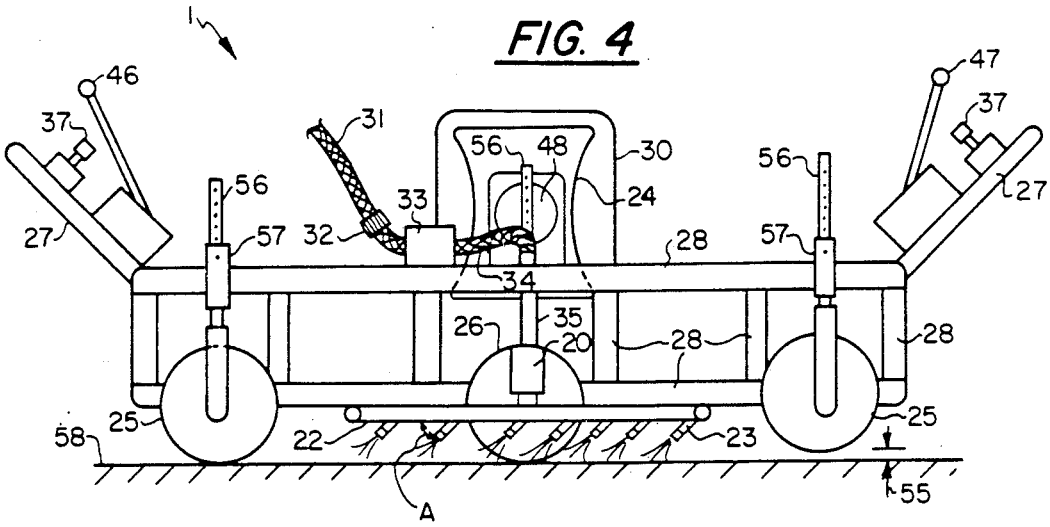

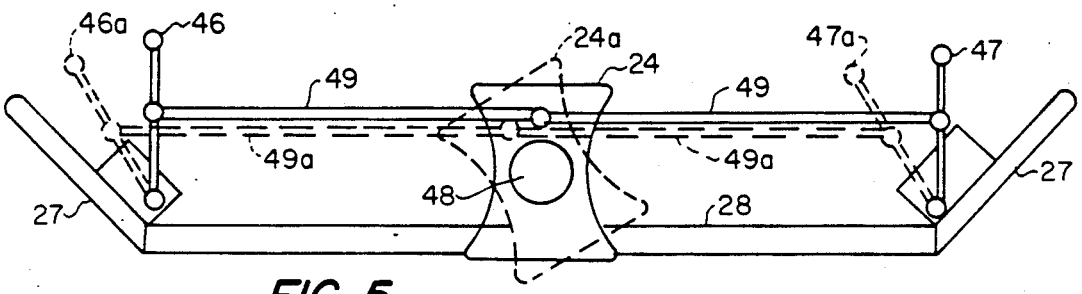
FIG. 5
FIG. 6
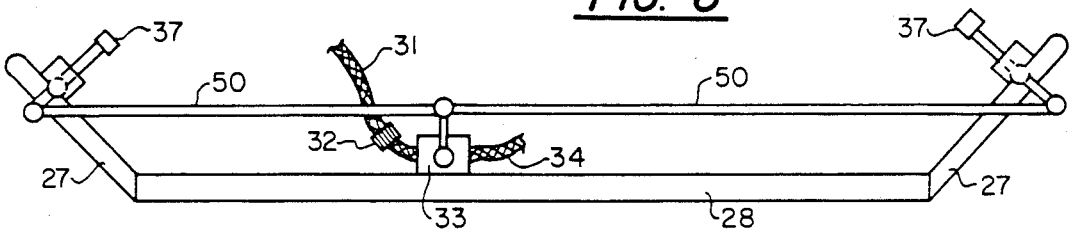
FIG. 7
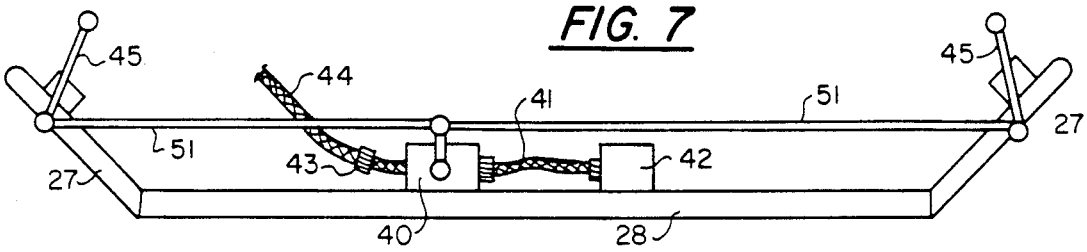
FIG. 8
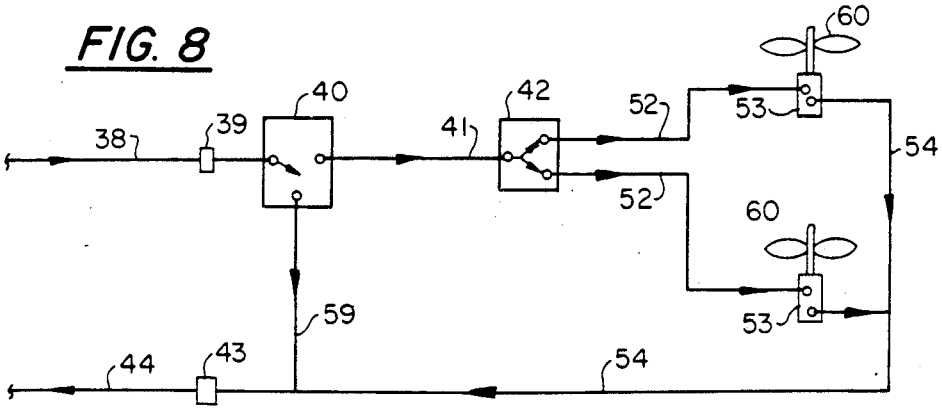

FLUID JET SYSTEM AND METHOD FOR UNDERWATER MAINTENANCE OF SHIP PERFORMANCE

BACKGROUND OF THE INVENTION

1. Field of the Invention

This invention relates to a fluid jet system and method for removing deposits, organic and inorganic, from submerged surfaces and for smoothing those surfaces. More particularly, this invention relates to an assembly of underwater, diver-controlled equipment, and the methods of using the same to provide rapid and efficient cleaning and smoothing of submerged surfaces, without harming either the surface material or protective coatings, in order to maintain ship performance.

2. Description of the Related Art

The degree of surface roughness of submerged portions of ships has a great effect on both ship fuel efficiency and the speed which can be achieved at a given propeller revolution rate. Roughness can be caused by marine growth ("fouling"), degradation of hull coatings, and deterioration of unpainted surfaces such as propeller blades. For commercial, private, or military ships, losses in ship performance can have a variety of consequences, both financial and in terms of meeting scheduled arrival dates.

Although the following examples are for a VLCC (Very Large Crude Carrier; an oil tanker, with the following typical approximate specification: 272,000 tons deadweight; total engine horsepower (at 90 RPM propeller rate): 32,700 hp), examples could be given for any size or type of marine craft. A typical trip for a VLCC is from the U.S. Gulf Coast to the eastern end of the Mediterranean Sea. This round trip normally takes about 40 days. However, with an increased surface roughness causing a loss in peak speed of only 1 knot (nautical mile per hour), 2 ½ days would be added to the trip. At a typical $15,000 per day of lost utilization, this would cost the tanker owner about $37,500.

Considering the effect of surface roughness on efficiency, for a VLCC, each increase of 1 RPM in propeller rotation rate corresponds to an increase in ship speed of about 0.15 knot. Thus, a roughness caused loss of one knot would require an increase of about 6.7 RPM to maintain the same ship speed (i.e., to overcome the increased ship resistance). This increased propeller speed costs about 20 tons (metric ton) per day of extra fuel. At a cost of about $75 per ton, for the 40 day round trip discussed above, this would cost about $60,000.

Marine engineers estimate that an increase in the average roughness of a ship's hull of about 30 microns (peak-to-peak, RMS roughness) can cause a drop in peak achievable speed of about one percent. A new hull can have a surface roughness of about 160 micron. A deteriorating AF (Anti-Fouling) coating can be about 280 micron. This roughness increase could cause a four percent drop. For a typical 16 knot VLCC peak speed, this would be a loss of about 0.64 knots. Additional roughness due to a fouled propeller could easily double this speed loss.

The foregoing clearly demonstrates the economic importance of maintaining the submerged surfaces of ships in as smooth a condition as is practical. Therefore providing a means to maintain surface smoothness of ships is a practical and economical objective for ship owners.

The usual method of ship hull maintenance is to remove the ship from service, place it in a dry dock, and sandblast off the marine growth and all or part of the protective coating systems. Usually all of the AF (anti-fouling) coating is removed, and loosely adhered AC (anti-corroding) coating layers are also removed. The hull is inspected for damage or deterioration; repaired if necessary; and new AC and AF coatings applied. However, areas of about 3 by 8 ft., where the hull rests on the dock-blocks which support the VLCC in dry dock, are not coated. There can be as many as 400 "dock-block-shadows," and as much as ten percent of the hull can be involved. Because these "shadows" are not coated, they foul very rapidly once the VLCC is returned to service. As the typical period between dry docking for a VLCC is about 36 to 60 months, marine growth on the uncoated "shadows" can be 1 ft or more by the next dry docking. Therefore, the "shadows" are a major source of performance loss.

The dry docking process is very expensive and the ship is removed from useful service during dry docking. In addition, the AF coating can begin to lose its effectiveness after only 18 months of service.

It would therefore be desirable to provide a means to maintain hull and propeller smoothness by removing marine growth between dry dockings so that dry docking frequency can be decreased without performance loss.

Some methods for underwater removal of fouling from ship hulls and propellers have been used. For example, devices have been proposed which consist of one or more fixed or rotating brushes, configured in various ways and sizes; ranging from small, single brushes that a diver may use to clean a propeller, to a large powered brush system. An example of such a brush cleaner is U.S. Pat. No. 3,859,948 to Romano et al. However, these devices have a number of unsatisfactory characteristics.

The principal disadvantages of the powered, rotary brush systems, when used for hull cleaning, are:

(a) damage to AF coatings —— The brushes score and roughen these soft coatings. The increased roughness due to coating damage can significantly offset the gains from fouling removal. Thus, such systems do not achieve the full potential objective of reducing surface roughness to reduce speed and energy losses.

(b) increase in the rate of subsequent marine growth —— The brushes merely cut, and do not fully remove the stalks of marine plants. Thus, the remaining stalks bifurcate, and experience enhanced subsequent growth. The cut-free portions, on the other hand, are smeared around on the surface and are left to re-root. Similarly, seeds are disturbed and then re-implanted. By these three mechanisms, because rotary brushes do not fully remove and blast away the vegetative growths, the subsequent regrowth is faster than the pre-brushing growth rate. This requires more frequent brush cleanings in an attempt to maintain ship performance.

A variety of other surface cleaning devices have also been developed which use water jets, sand blasting nozzles, or brushes. Typical are the devices disclosed in U.S. Pat. Nos. 4,163,455, 4,220,170, and 4,462,328; and Japanese Patent No. 58-236285. Each of these devices, however, require some type of external means for: (i) causing the cleaning unit to adhere to the surface being cleaned; and (ii) causing the cleaning unit to be positioned and moved along that surface. Thus, because these devices lack an independent capability for performing these functions, they are incapable of effectively servicing the complex, varying surfaces, in terms of cleaning/smoothing requirement, represented by a submerged ship hull.

Yet another system which was developed for cleaning/smoothing the hulls of smaller, typically privately-owned boats, and some smaller commercial craft is illustrated in FIG. 18. This earlier cart used several, independent sets of water jet nozzles to perform the functions of forwardly propelling the cart, steering the cart, clamping the cart to the ship hull, and cleaning/-smoothing the hull. In that design, then, water jets 70 provided forward propulsion, jets 73 disposed on each side of the cart near the front were intermittently activated by the diver to steer the cart, and a set of jets 72 on each side provided the force which clamped the cart wheels 26 to the ship hull. Thus, no hydraulic fluid powered motors were required for the cart's operation. Such a design was particularly well suited for the servicing of smaller, private boats, situated in crowded marinas, and where it is desirable to minimize the diesel engine noises and to avoid the chance of polluting the marina as a result of a hydraulic fluid leak. However, that design was unsuitable for cleaning the hulls of larger ships.

The type, location and extent of fouling on ship hulls determines what influence the fouling is having on ship performance. It would therefore be desirable to provide a method for surveying the underwater surfaces of the ship prior to initiation of a cleaning process so that a decision can be made as to whether an underwater maintenance effort is necessary or desirable to improve ship performance and to what parts of the hull should be cleaned. An approach to underwater hull inspection has been disclosed in U.S. Pat. No. 3,776,574. That approach calls for marking the hull with a visible subdividing, to indicate each discrete subarea on the hull; and marking a number or letter in each of these subdivided areas, thus providing a "map" for the diver to follow during his underwater inspection. It would be desirable, however, to provide an underwater hull inspection procedure which does not require such an artificial marking of the hull.

SUMMARY OF THE INVENTION

In view of the substantial cost and time savings afforded by maintaining the submerged surfaces of ships in as smooth a condition as is possible and by avoiding frequent dry docking and in view of the problems associated with underwater brush systems for ship hull cleaning, it is an object of the invention to provide a system and method for its effective and efficient usage which can be safely and easily operated by a single diver, even during adverse conditions such as rough seas, strong currents, and extremely opaque water visibility and which can effectively remove both organic and undesirable inorganic material from the submerged hull of a vessel to maintain that hull in a smooth condition without enhancing marine growth.

To achieve the foregoing objects, the present invention includes a set of components which have been combined to form a system for cleaning and smoothing the submerged surfaces of ships, such as hulls, propellers, rudders, supporting members, and any other submerged ship components which, if allowed to roughen through marine growth and/or surface deterioration, can contribute to friction-caused decreases in ship performance.

More particularly, in accordance with the present invention, it has been found that such objects can be achieved with an array of high-pressure fluid jet nozzles, affixed onto a self-rotating manifold, with the cleaning nozzle manifold mounted on a self-propelled, diver-controlled cart, independent of any external means to either guide, position, or support it, that rolls, underwater, across the bottom and sides of a ship hull. Thus, the hull cleaning/smoothing cart (hereafter referred to as "the cart") of the invention comprises a light-weight, open-frame fabricated from, for example, aluminum frame elements; floatation means such as foam-filled buoyancy compartments; an array of high-pressure fluid jet nozzles defined on a self-rotating manifold which is in turn fluidly coupled to the main frame; four wheels, mounted so that no more than three of the four wheels will be in contact with the hull at any given time during the usage of the cart; two tiltable or orientable thruster assemblies, one mounted on each side of the cart, to provide longitudinal propulsion of the cart along the hull surface, to urge the cart, wheels first, against the hull surface, to direct debris removed from the hull of the ship by the fluid jets away from the vicinity of the hull, and to deploy the cart through the water down to the desired starting point on the hull; and control means at each end of the cart for turning the flow of high-pressure water to the nozzles on or off, for changing the tilt angle of each thruster assembly independently, and for varying the speed of revolution and hence the thrust-force produced by the thrusters, so that the cart can be driven from either end, in either direction.

The system of the invention includes the cart; one or more small, diver-held tools for cleaning/smoothing appendages such as an erosive-jet diver tool of the type disclosed in U.S. Pat. No. 4,716,849 to Conn et al, the disclosure of which is incorporated herein by this reference, and/or one or more small, hydraulically-powered polishing brushes for propeller smoothing; a high-pressure water pump unit to feed the cleaning/smoothing water to the nozzles on either the cart or the erosive-jet diver tool; a hydraulic pump unit, to provide pressurized hydraulic fluid for powering the motors which rotate thruster units on the cart; a hose reel, to facilitate the deployment and retrieval of a multi-hose bundle, including one high-pressure water hose and two hydraulic hoses that are coupled to the cart; a feed-water subsystem, for supplying clean seawater to the high-pressure water pump, including a centrifugal feed-water pump, a submerged suction basket, and filter units; and a subsystem for supplying air and communication means to the divers, including air compressors, an air storage tank, radio gear, and diver-helmets, with interconnecting air hoses and radio communication cables.

This invention also embraces methods which have been developed for underwater surveying of the ship to monitor and document the degradation process. The associated analyses then indicate the optimal time to initiate underwater maintenance work on that ship and what areas should be cleaned/smoothed in a prioritized rating for those not-unusual cases wherein the time available to work on the ship is not sufficient for cleaning all of the submerged surfaces.

Other objects, features, and characteristics of the present invention, as well as the methods of operation and functions of the related elements of the structure, and the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 1 is a schematic view of the underwater ship maintenance system, showing each necessary component positioned on a work boat deck;

FIG. 4 is a schematic side elevational view of the cart taken along line 4—4 in FIG. 3;

FIG. 5 is a partial side elevational view of the cart, showing the controls and linkages for tilting the thruster assemblies;

FIG. 6 is a partial side elevational view of the cart, showing the controls and linkages for controlling the water flow to the nozzles;

FIG. 7 is a partial side elevational view of the cart, showing the controls and linkages for the controlling the flow of hydraulic fluid to the thruster motors;

FIG. 8 is a schematic drawing of the hydraulic fluid circuit;

DETAILED DESCRIPTION OF THE PRESENTLY PREFERRED EXEMPLARY EMBODIMENTS

Figure 2:
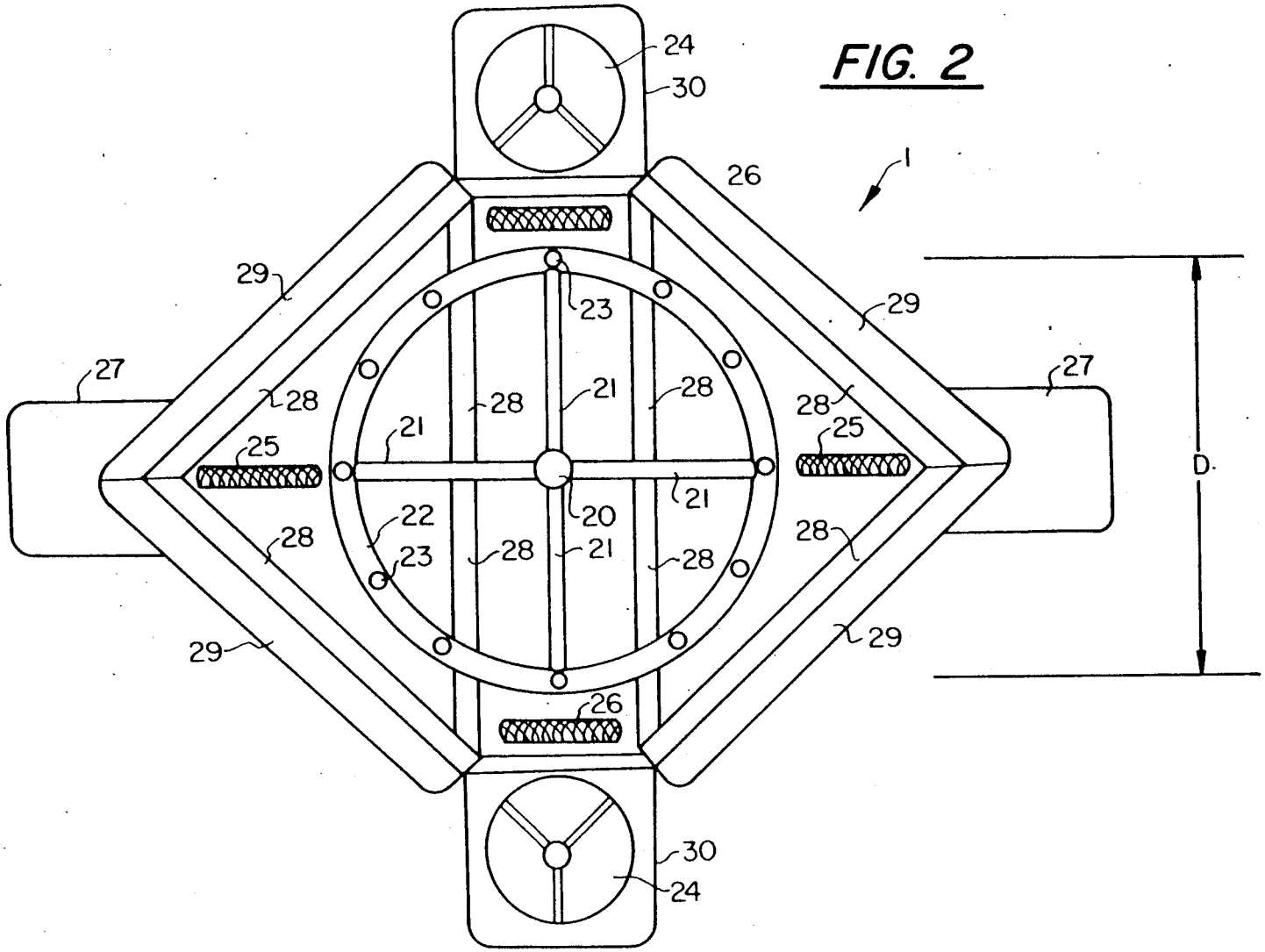
FIG. 2 is a schematic bottom plan view of the hull cleaning/smoothing cart of the invention.

Reference will now be made in detail to the presently preferred embodiments of the invention, examples of which have been illustrated in the accompanying drawings.

To illustrate how the present invention is used and the advantageous improvements to and maintenance of performance of many types and sizes of ships it provides, methods of deploying and operating the system of the present invention in a typical manner for servicing VLCC's will be described in a sequential manner. The details of the apparatus will then be described. Finally, the methods used to determine where on the hull, and when the system of the invention should optimally be employed, will be described.

The system has been designed to incorporate several readily transportable and replaceable modules which are schematically shown in FIG. 1. These modules can be stored in a warehouse between uses; transported, for example by flat-bed truck to dockside; and then lifted by a dockside crane or the like and placed, as illustrated in FIG. 1, on the deck of a work boat. This work boat can either be leased, or can be owned and dedicated to the present purpose, with the system permanently installed thereon. In the alternative the system can be disposed on a dock or pier and the ship to be serviced can be tied up adjacent to the dock or pier. If the ship to be serviced is anchored offshore, as is often the case with a VLCC, then the work boat approach must be used. In that case, the work boat is taken out to the ship to be serviced and tied up adjacent thereto. Typically this tie-up is made sequentially at three sites: near the stern, then midships, and finally near the bow. At each tieup, the cart is deployed, and about one-third of the hull area is cleaned. This approach is used for hulls that are over 1,000 feet long, in order to avoid having to handle hose lengths that are longer than about 350 feet.

Referring to FIG. 1, interconnecting hoses 3, 5, and 8, for water; 11, 12, for hydraulic fluid; and 15, for diver's air supply, are connected between the modules. These modules include a high-pressure pump unit 7; a centrifugal, feed-water pump 4; a suction basket 2; a filter unit 6; a hydraulic pump unit 10; a hose reel 9; air compressors 14; and air storage tank 16. A winch 18*a* and a davit 18*b* are further provided to lift the cart 1 from the deck of the work boat and to place it in the water. A removable diver's ladder 19 can be provided as well for entering and leaving the water. Each of the pumps 4, 7, 10 and the air compressors 14 are powered, for example, by diesel engines. The suction basket 2 serves to prevent large particles (greater than about 0.25 in.) from entering the feed-water pump 4. Two, in-parallel filter housings are disposed in the filter unit 6. The filter elements are preferably made of stainless steel so as to be washable and reusable. The filter element grid size is typically about 80 mesh (177 microns). The feed-water pump is preferably capable of lifting the seawater up a height of about 20 feet and the output pressure is about 265 psi, at a flow rate of up to 90 gpm (gallons per minute).

Figure 10:
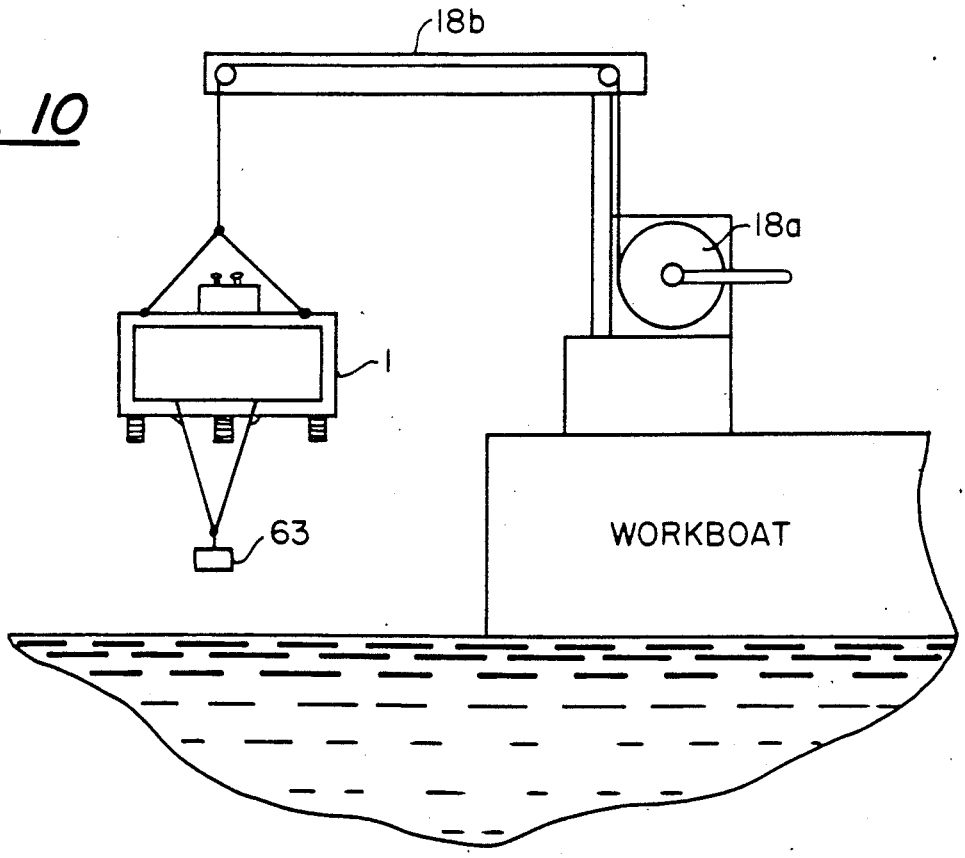
FIG. 10 is a schematic drawing showing the cart in the process of being deployed from the work boat into the water.

When the cart is to be deployed one or more divers are fitted with diving helmets which have been connected to the air hoses and communication wires 17. The air compressors 14, are activated thereby charging the air storage tank 16 to insure an emergency feed of air in case of a failure of both air compressors. The cart 1 is connected to the winch 18*a* and the davit 18*b* is used to swing the cart out over the water. The cart, for deployment purposes only, is temporarily affixed with removable weights 63 which serve to make the cart about five pounds negatively buoyant (FIG. 10). The cart can therefore be lowered in a stable manner to a depth below the surface region that is affected by wave action. This facilitates work by the diver on the cart, as described below, before the cart is removed from the winch.

A multi-hose 13 consisting of about 350 feet of: (a) high pressure water hose 31, (b) hydraulic fluid feed hose 38, and (c) hydraulic fluid return hose 44, is fully deployed, with assistance from the diver. The first 50 ft of the high-pressure water hose (on board) is preferably constructed of a larger diameter and heaviercoated material than the remaining 300 feet. The purpose of this initial heavy section of hose is two-fold: (a) to provide excess mass for damping the pulsations that are imparted to the hose by the fluctuations in the output pressure of the multi-plunger positive-displacement high-pressure water pump. This heavy hose section stops these pulsations from continuing down to the cart and being a fatiguing factor for the diver operating the cart; and (b) the heavy coating on this initial hose segment is able to survive, for longer time periods, the abrasive wear that is caused by the vibrations of the hose while it is in contact with the deck of the work boat.

Figure 3:
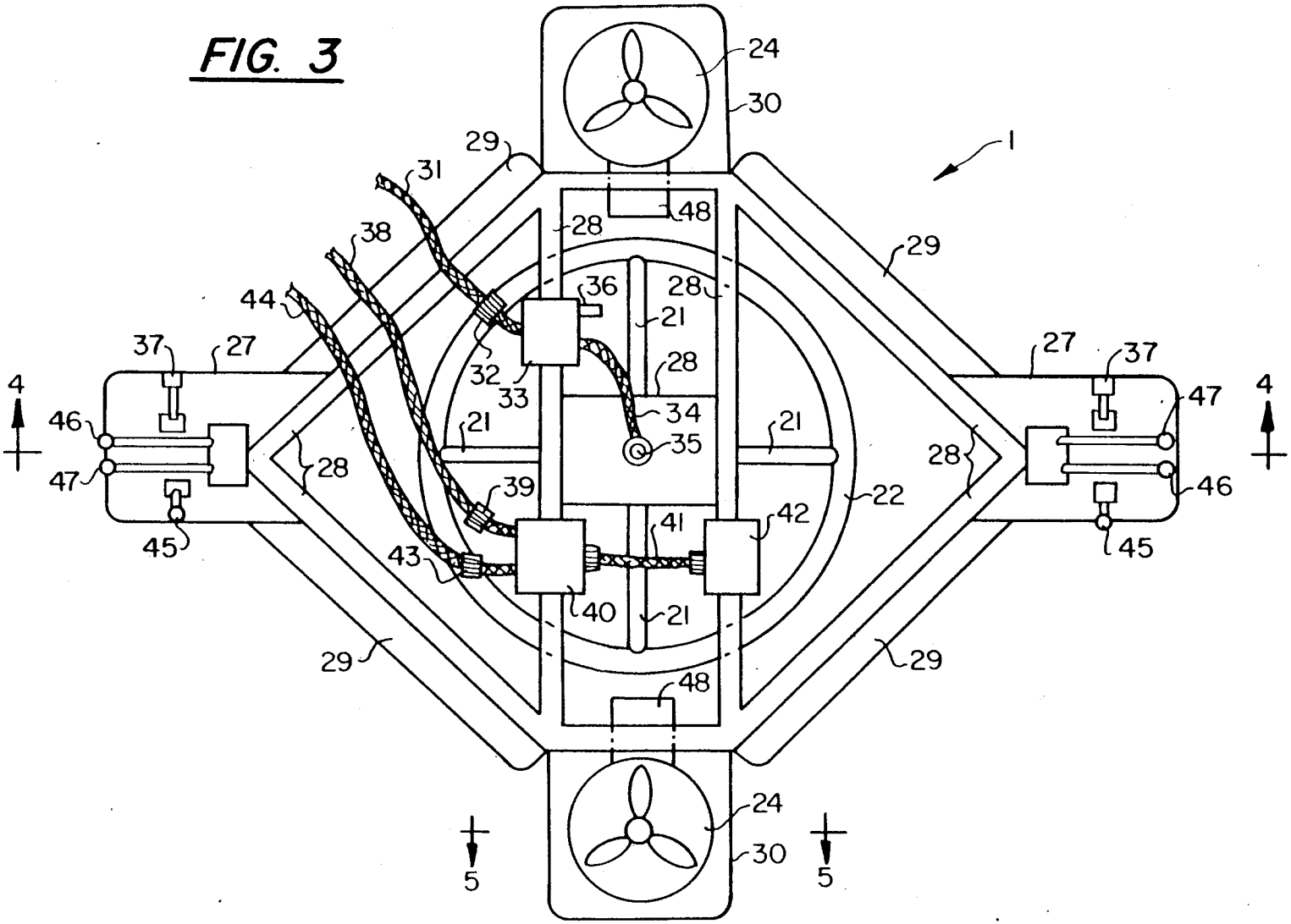
FIG. 3 is a schematic top plan view of the cart.

Each of the three hoses is connected to the cart by means of the three quick-connect couplings 32, 39, and 43, respectively, (FIG. 3). The quick-connect couplings allow the diver to fasten the hoses in a pressure tight manner, without the use of any wrenches.

The crew on the deck of the work boat then turns on all of the pump units 4, 7, 10. The diver removes the weights 63 and disconnects the cart from the winch, allowing the cart to float freely. Control-lever 45 is then activated, causing the flow of hydraulic fluid through the control-valve 40 to be directed away from the bypass hose 59 (FIG. 8) and into the feed-hose 41 and hence to the flow-divider 42. From there, the hydraulic fluid flows in two equal amounts through hoses 52 to the two hydraulic motors 53 which provide the rotating force for the two thruster blade sets 60. The hydraulic fluid circuit is completed by a return hose 54 which leads back to the quick-connect coupling 43, main return hose 44 to the hose reel 9 and return hose segment 12 between the hose reel and hydraulic fluid pump unit 10 (FIG. 1).

With the thrusters now in rotation, the amount of thrust can be varied as desired by moving control-level 45 which is connected through linkage 51 (FIG. 7) to the hydraulic fluid control-valve 40. The diver can control the motion, direction, and speed of the cart through the water, on the other hand, by means of the control-levers 46 and 47 which are duplicated at both ends of the cart, so that the diver can drive the cart in either direction, and control the cart from either end. Control-lever 47 controls the tilt of the port-side (left-side) thruster-housing 24. Control-lever 46 controls the tilt angle of the starboard-side (right-side) thruster-housing 24. As seen in FIG. 5, the control-levers, 46 and 47, are connected to the thruster-housing, 24, by linkages, 49. When the control-levers are moved, the thruster-housings, which are mounted to the main frame of the cart by swivel-supports 48 are caused to move through an angle equal to what the diver imposes on the control-lever. In this manner, the diver can know just how much the thruster is being tilted, even if the cart is being operated in water which is so opaque that he cannot see the thrusters from his position at the control-station 27 at the end of the cart. By tilting the two thrusters at different angles, the diver can cause the cart to steer either right or left. Further, to facilitate the trip down from near the surface to the ship's bottom hull area, the diver may choose to invert the cart, to achieve maximum thrust advantage from the two thrusters.

Once the temporary, deployment weights 63 are removed, the cart is slightly positively buoyant, at about five pounds of positive lift force. Thus, once the cart is in position against the ship hull, the buoyancy of the cart will tend to keep it pressed against the hull, even if power is not being sent to the thrusters. Thus, the diver can use the thrusters to drive the cart down through the water to that site on the submerged portion of the ship hull where he plans to begin the cleaning and smoothing process.

Figure 11:
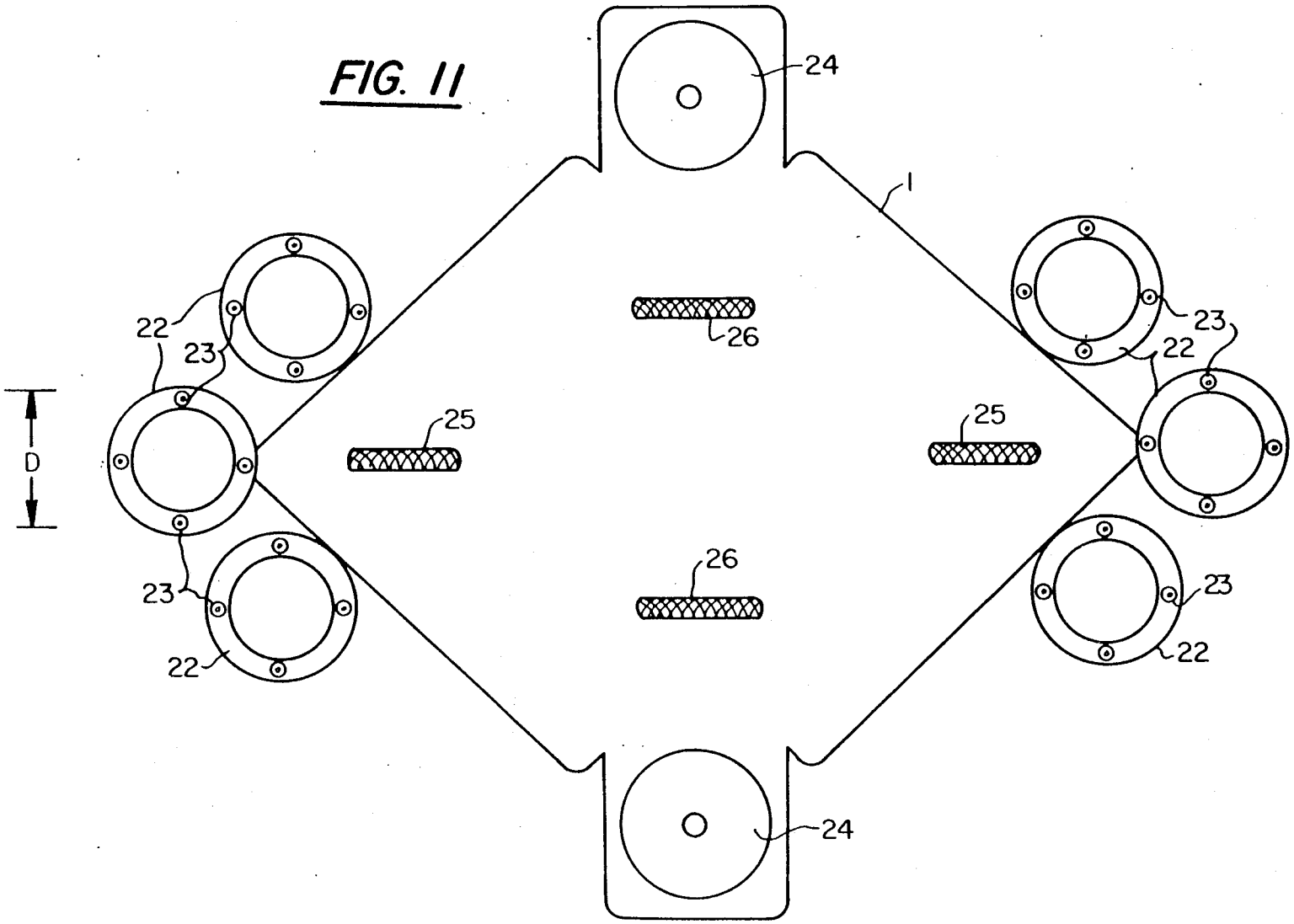
FIG. 11 is a schematic bottom plan view of an alternative arrangement of the nozzle manifold and the wheels.
Figure 12:
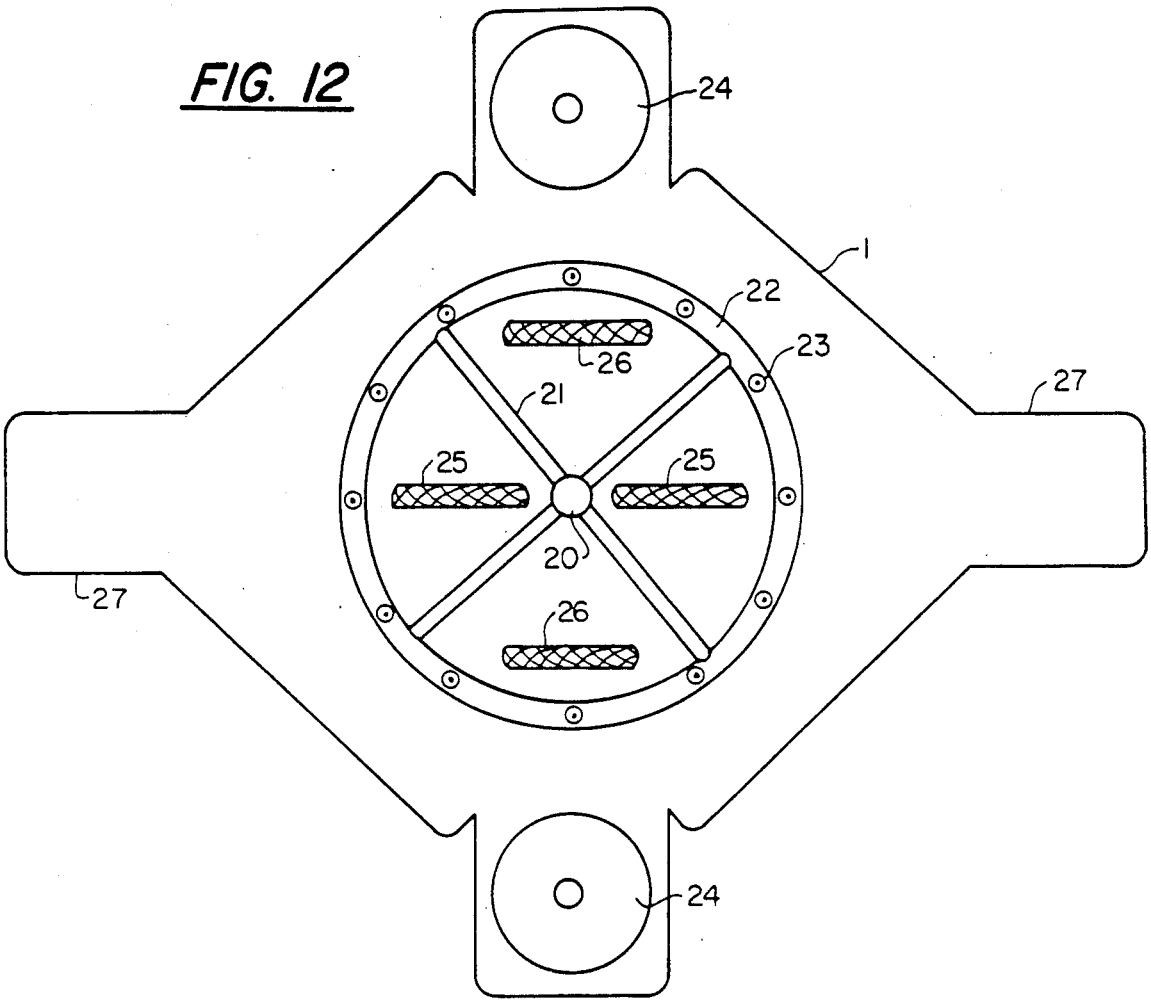
FIG. 12 is a schematic bottom plan view of another alternative arrangement of the wheels.
Figure 13:
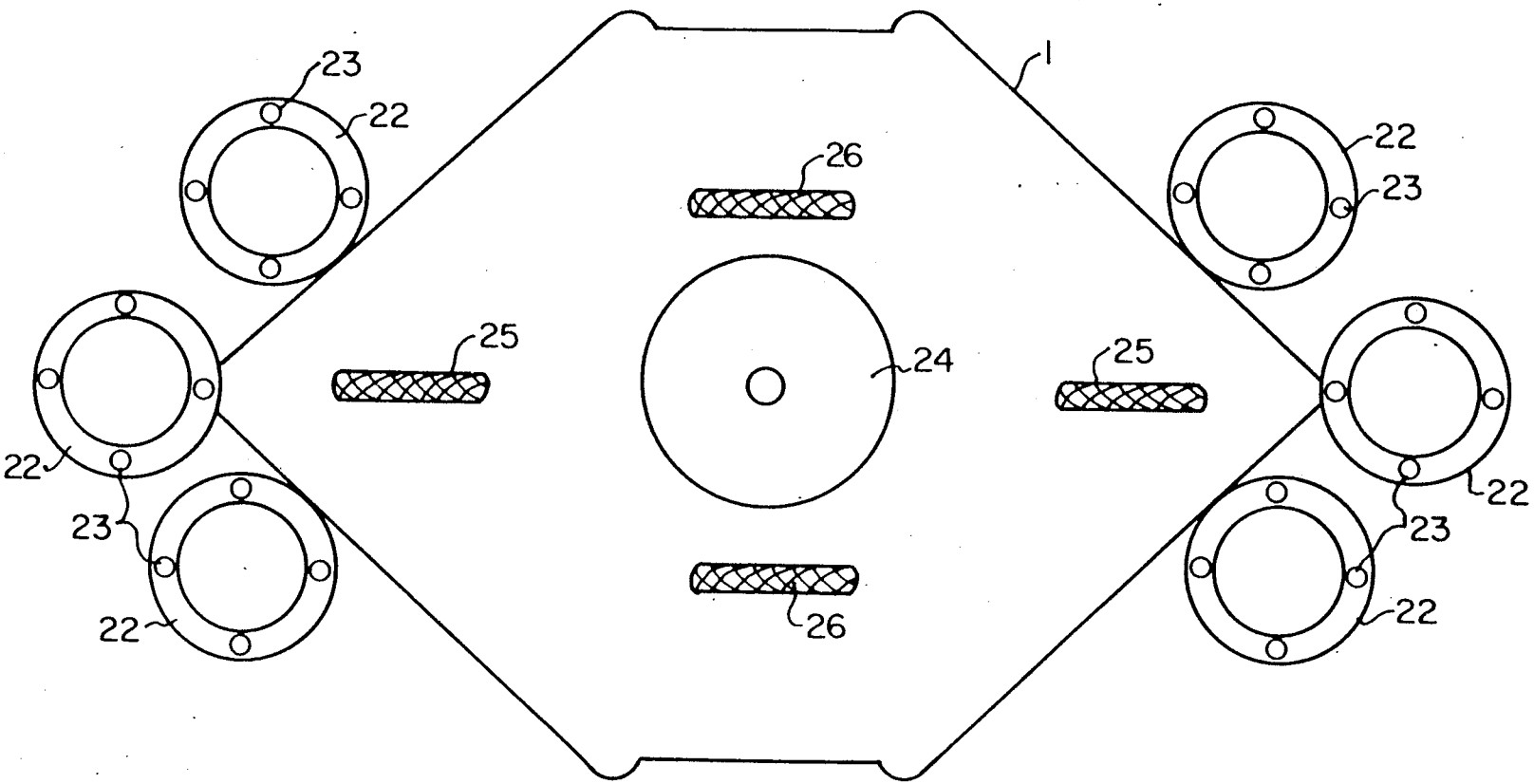
FIG. 13 is a schematic bottom plan view of a further alternative arrangement of the nozzle manifold and the wheels, and including a single, centrally located thruster.

The cart is configured so that no more than three of the wheels will be in the same plane at any given time. Wheel positions can be adjusted vertically by locking the shaft 56 as required in the collar 57. Thus, when the wheels of the cart 25, 26 are against the hull 58 to be cleaned (FIG. 4) there will always be a gap 55 between the front or back wheel 26 and the hull surface 58. The purpose of this design is to insure that the cart is always in solid contact with the hull, which is a complex, multi-curving surface. By providing for the gap 55, then, the three remaining in-contact wheels will always define a plane-of-contact. Thus, no matter what the local curvature of the hull is, these three wheels will always be in solid contact with the hull. Further, the wheel diameters are large, typically about 10 inches, to facilitate rolling over hull discontinuities such as welds or misaligned hull plates, as well as some large barnacles. For very large barnacles, one of the alternative embodiments of the cart might be required (FIGS. 11, 12 or 13).

With the wheels of the cart in place, and the diver ready to begin his cleaning/smoothing pass down the ship hull, the thrusters are used to control: (a) the forward speed of the cart, (b) the steering, left or right, and (c) the amount of the clamp-on force between the wheels of the cart and the ship hull. By varying the angle-of-tilt of each thruster, and the speed-of-rotation of the thrusters, the diver has complete control of each of these three factors, which, as will become more apparent below, are essential to achieving fast and effective cleaning/smoothing of the hull surface. The clamp-on force has been shown to be an important factor in the efficient operation of the cart. In particular, on the sides of the hull, which can be very slippery due to the growth of slimy marine organisms, it is necessary to impose a large enough clamp-on force to insure positive traction for the wheels, and hence keep the cart rolling in a continuous and straight-line manner.

To begin the action of the cart, the diver uses control-lever 37 (FIG. 6) which is connected by linkages 50 to the high-pressure water diverter-valve 33. In the non-working position, valve 33 diverts the water flow through dump-port 36 (FIG. 3). Dump-port 36 is designed to be large enough so that the water pressure in operating system pressure. Then, when the diver uses lever 37, he causes the diverter valve 33 to stop diverting the water flow through the low pressure dump-port 36 and thus to send the water through a feed-water hose segment 34 through feed-pipe 35 and thence to a rotary swivel-joint 20. Swivel 20 allows the high-pressure water to be fed from stationary pipe 35 to a rotatable circular manifold 22. In the embodiment illustrated in FIG. 3, the water is routed from the swivel 20 to the manifold 22 by means of the four feed water pipes 21. These four pipes also serve as the support-spokes for the manifold, 22, and are welded to the manifold to form a single element for the high-pressure water. To decrease the drag forces on these spokes, as they move through the water, each spoke is designed with an external geometry that is "streamlined", that is, with a foil-shape that is configured for drag-reduction. In this manner, as detailed in the next paragraph, the amount of thrust that is required from the nozzles 23 is minimized. This allows the angle A to be larger, which thence increases the cleaning/smoothing intensity that these jets can deliver to the surface. Affixed to the manifold 22 are a set of nozzles 23. A typical configuration for a cart designed to clean a VLCC is a manifold diameter D of about 36 inches with, for example, twelve cleaning/-smoothing fluid jet nozzles 23.

The nozzles 23 are preferably not mounted so as to be perpendicular to the plane of the manifold 22. Indeed, as shown in FIG. 4, these nozzles are mounted at an angle A with respect to the plane of the circular manifold. Angle A, which is typically about 80 degrees, is to allow a portion of the thrust from the set of jets 23 to provide a rotating force for the manifold 22 as well as to provide a chipping-like material removal function. Where twelve nozzles are provided operating at a pressure drop of about 2,000 psi and a total flow through the set of nozzles of about 90 gpm, the rotating speed of the manifold is typically about 90 RPM. This controlled speed of rotation of the manifold is another key factor in the rapid and efficient usage of the cart for varying hull conditions, as discussed more fully below.

The nozzles 23 that are used with the cart 1 are designed to harness the phenomenon known as "cavitation", in order to provide a more effective cleaning and smoothing action for underwater servicing of ship hulls. Thus, nozzles of the type which enhance the creation of cavitation in and around the fluid jet, typically water or seawater, which issues from the nozzle are preferably provided. Suitable cavitating jet nozzles are disclosed, for example, in U.S. Pat. Nos. 3,528,704, 3,713,699, 3,807,632, 4,389,071, and 4,474,251, the disclosures of which are incorporated herein by this reference. The cavitating jet nozzles and cavitation enhancement techniques disclosed in the referenced patents are preferably utilized in accordance with the present invention to enable more effective use of water flow and pressure that is provided by the high-pressure pump unit 7. In this manner, it is possible to achieve the objects of this invention while using a smaller, and hence less expensive, pumping unit.

Figure 9:
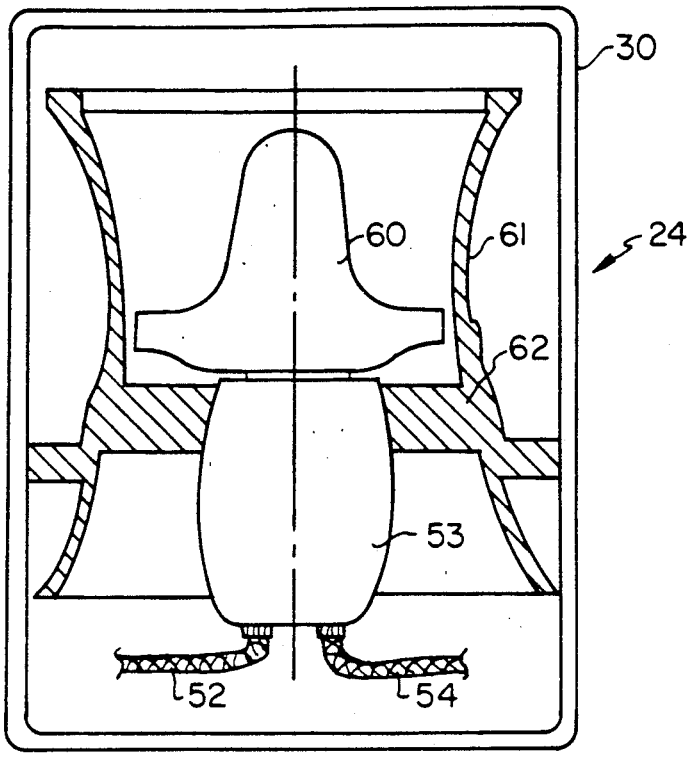
FIG. 9 is a partial side elevational view of the thruster assembly taken along line 9—9 in FIG. 3.

As illustrated in FIG. 9, the thruster assembly 24, also referred to as simply the thruster, includes hydraulic motor(s) 53, motor supports 62 for mounting the motor to thruster housing 61 and thruster blades 60. Each of these components is preferably hydrodynamically configured to provide a maximum thrust performance for the thruster so that the hydraulic pump 10 can be relatively small and inexpensive. A suitable performance enhanced thruster design is available from the Innerspace Corporation of Glendora, Calif. With that thruster and a hydraulic pump unit that provides hydraulic fluid of 8 gpm (four gpm to each thruster motor 53) and a pump pressure of about 2,000 psi, each thruster assembly 24 can deliver a thrust force of up to 250 pounds, at the maximum desired RPM of the hydraulic motor 53 and hence a total of 500 pounds for the two thruster assemblies.

As shown in FIG. 5, the thruster is mounted onto a swivel-support 48 which allows the thruster to be pivoted or tilted up to 45 degrees clockwise or counter-clockwise as viewed in FIG. 5. A counter-clockwise tilt, as indicated by the phantom view of the thruster assembly 24*a* is effected by moving either control-lever 46 or 47 to the position shown in phantom at 46*a* or 47*a*. The corresponding shift in the linkage 49 to phantom position 49*a* causes the tilt of the thruster 24*a*. The amount of total forward thrust that can be achieved is given by: $\sin 45° \times 500 = 354$ pounds, at the 45° limit of tilt of the thrusters. This amount of forward thrust has been found to be adequate for overcoming the drag forces on the cart, hoses, and diver, and allowing the cart to be propelled at the required speeds across the ship hull, under the typical conditions encountered during ship hull servicing.

As shown in FIG. 9, a protective housing 30 completely surrounds the thruster housing 61. This protective housing 30 serves to prevent impact damage. A coarse metal mesh or the like is applied to the bottom of the housing to prevent large floating objects from being ingested into the thruster.

There are certain design aspects of the cart that have been included in order to make the cart as light in weight as possible, which makes it easier to handle, both in the air, and by the diver in the water. For example, an aluminum framework design can be employed, using welded aluminum structural members 28 to minimize the drag forces on the cart as it moves through the water. To further ease the handling of the cart in the water, as noted above, the cart can be slightly positively buoyant when it is fully submerged in seawater. This can be accomplished, for example, by providing four foam filled buoyancy compartments 29 (FIGS. 2 and 3). The amount of foam is adjusted, with the cart in the water, until a positive buoyancy of about five pounds is established. Alternatively, this buoyancy can be provided by air-filled compartments.

As illustrated in FIGS. 11 through 17, there are several alternative arrangements which may be used for certain of the primary components of the cart 1. These illustrated alternative cart configurations will now be described.

FIG. 11 shows a set of three, smaller rotating manifolds at each end of the cart. It is contemplated that only one of the sets of nozzle manifolds would be used at a time. When the cart is moving to the left, as viewed in FIG. 11, then only the three manifolds 22 at the left end of the cart would be active. A water diverting valve would be used to send the high pressure water to only this one set. Then, when the cart reaches the end of a cleaning pass, the diver would switch the flow to the other set of manifolds, and proceed with a cleaning pass to the right, as viewed in FIG. 11. The diameter D of each manifold in FIG. 11 is about 12 in., or one-third the size of the single, large rotating manifold shown in FIG. 2. In this manner, the total path width cleaned by the cart would be the same from either arrangement. It is noteworthy that in the embodiment of FIG. 11, the port and starboard wheels 26 have been shifted in, to lie in a line behind each of the outer two cleaning/smoothing nozzle manifolds. Therefore, these wheels, as well as the center wheel at each end, will be rolling over a hull surface which has already been cleaned by the jets. In the case of a severely fouled hull, where very large barnacles have been allowed to grow, running the wheels along a cleaned portion of hull can be an advantageous. Indeed, the very large barnacles which can grow on a tanker (or other ship) hull can be so large as to make it difficult to roll the cart along the hull and may even stop a wheel from moving resulting in some lost time while the diver has to steer the cart around the obstruction.

As another alternative to provide a clean path for the wheels, the wheels can be configured as shown in FIG. 12. In that embodiment the wheels are mounted on a dolly which fastens to the feed pipe that brings the high-pressure water to the swivel 20. In this design, all four wheels are placed within the circumference of the single, large rotating circular manifold 22.

FIG. 13 has a wheel arrangement and nozzle manifold configuration corresponding to that shown in FIG. 11. However, in the embodiment of FIG. 13, rather than two thrusters 24 located on each side of the cart (as in FIGS. 2, 11, 12) a single, larger thruster 24 is placed in the center of the cart. The single thruster has a gimbal-type of support, so that it can be freely oriented in the needed direction to provide all of the required functions including forward propulsion, steering to the left or the right, and an adequate clamping force against the hull as well as debris removal.

Figure 14:
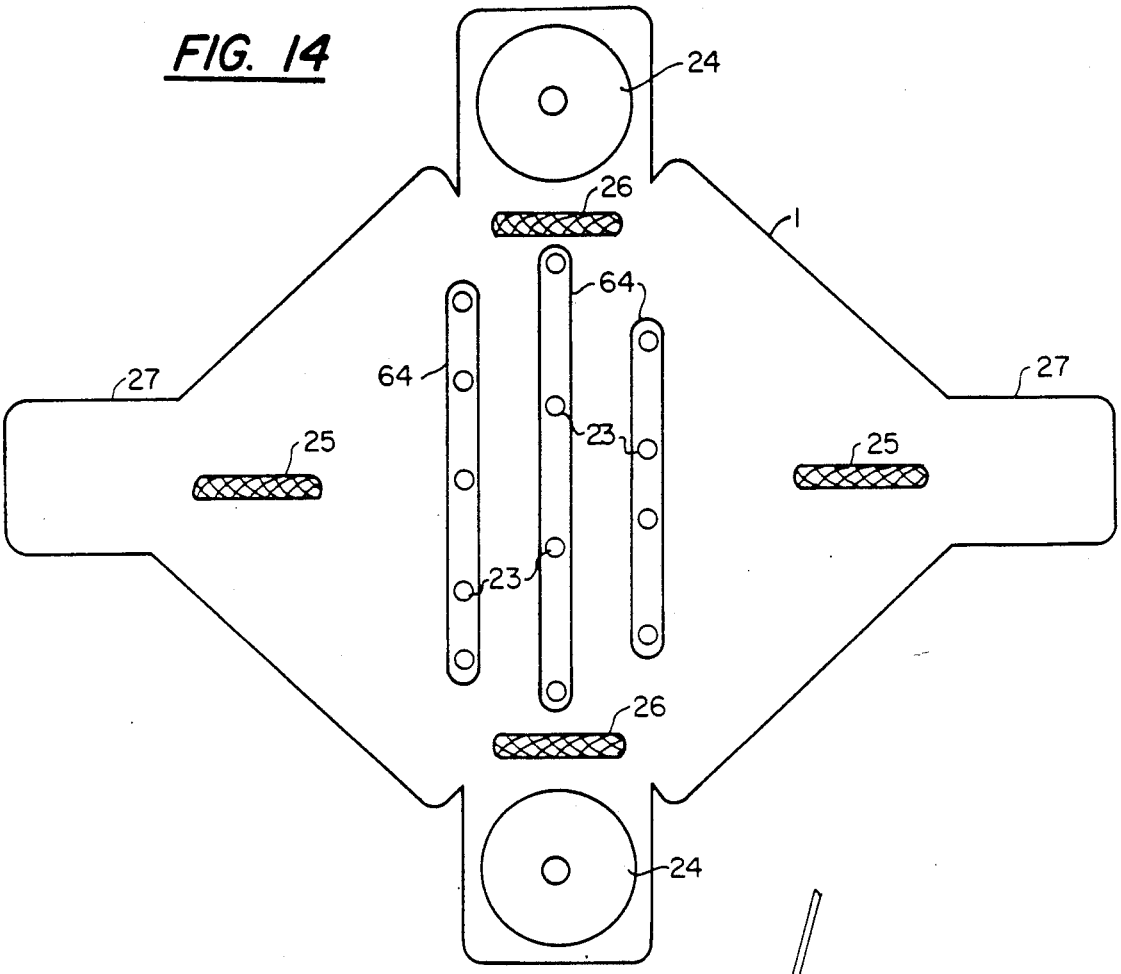
FIG. 14 is a schematic bottom plan view of yet another alternative embodiment of the nozzle manifold, with several, fixed manifolds.

A further alternate nozzle configuration is shown in FIG. 14. In this embodiment, a set of fixed, linear nozzle manifolds 64 are provided. The nozzles 23 affixed to these stationary manifolds are positioned so that as the cart passes over the hull surface, the individual paths cleaned by each nozzle overlap so that a full cleaned path is obtained having a width corresponding to the diameter D of the circular, rotating manifold of the embodiment of FIG. 2.

Figure 16:
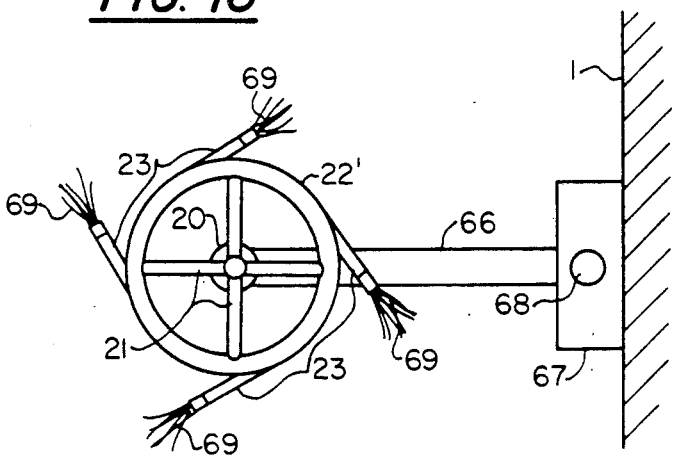
FIG. 16 is a partial schematic bottom plan view of the cart taken along line 16—16 of FIG. 15.
Figure 15:
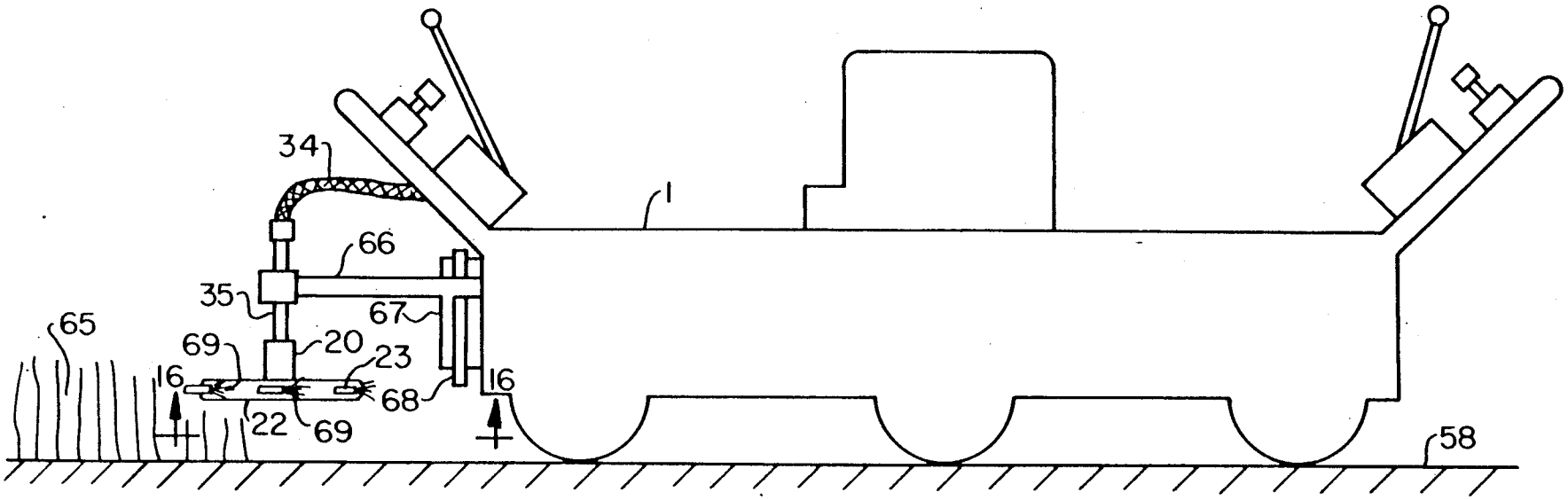
FIG. 15 is a side elevational view of the cart, detailing an alternative horizontallycutting nozzle manifold arrangement.

As noted above, "dock-block-shadows," do not receive the protection of an AF coating. Therefore, fouling from marine growth begins immediately upon redeployment of the vessel. In a few months, depending on where the ship is in service, this marine growth can reach 12 inches or more. This very large marine growth cannot be readily removed by the centrally disposed, downwardly directed nozzle manifold design depicted in FIG. 2. Therefore, in accordance with a further feature of the invention, as shown in FIGS. 15 and 16, a small, self-rotating nozzle manifold 22' is further provided and is mounted to the end of the cart 1 by means of a support block 67, a rotatable support shaft 68, and a movable support arm 66. These movable supports allow adjustment of the position of the manifold 22' up and down, depending on the height of the marine growth 65; and/or left or right, to facilitate reaching all parts of the "shadow" growth, while minimizing movements of the entire cart. As can also be seen, jetting action 69 of the nozzles 23' is oriented in a plane that is parallel to the hull surface. In this manner, the cutting action is horizontal, allowing the tall grasses to be mowed down to a level which would then allow for the final complete cleaning and smoothing action of the main manifold 22 of nozzles 23.

Figure 17:
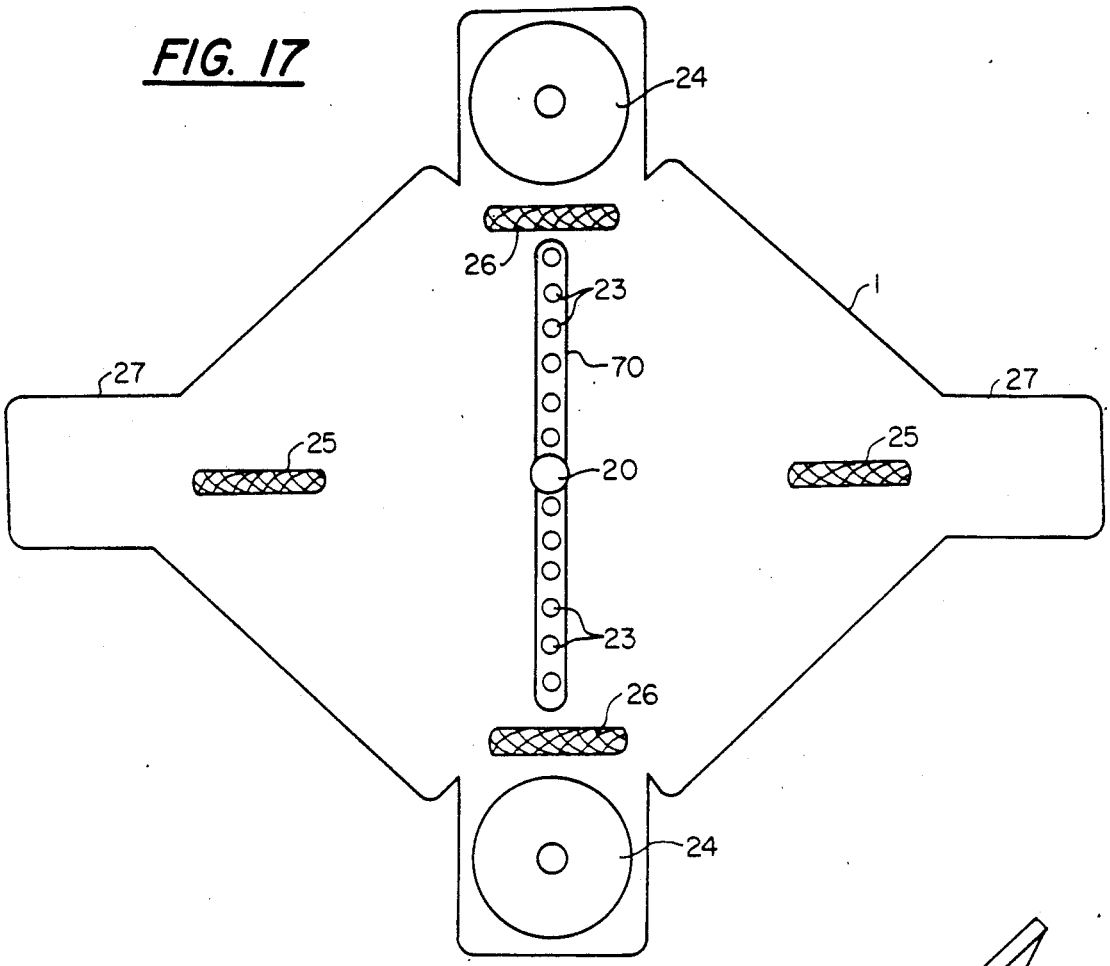
FIG. 17 is a schematic bottom plan view of yet a further alternate nozzle manifold arrangement.
Figure 18:
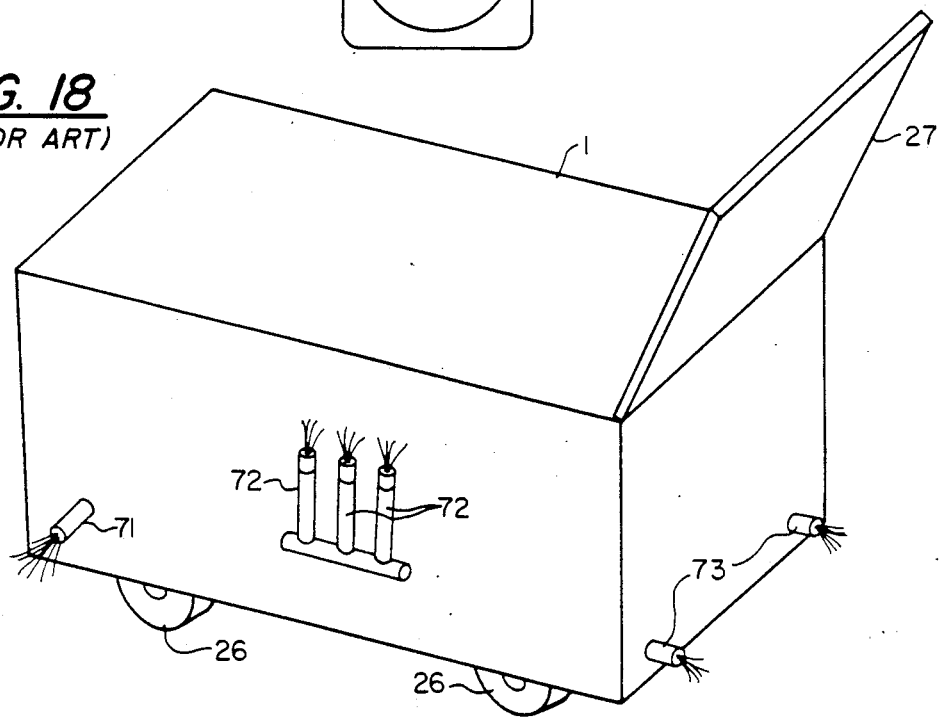
FIG. 18 (PRIOR ART)
FIG. 18 is a schematic perspective view of a cart in accordance with the invention which is fully powered, steered, and controlled by means of specially-positioned sets of high-pressure water jet nozzles.

In FIG. 17, yet another nozzle manifold arrangement is shown. In this embodiment the nozzles 23 are arrayed along a single, linear, rotating manifold 70. This manifold like the circular manifold of FIG. 2, is self-rotating by means of the orientation of the set of nozzles. Thus, for a manifold which rotates clock-wise as seen in FIG. 17, the nozzles above the swivel 20 are oriented to the left at an angle of about 80 degrees relative to the plane of the nozzle manifold to provide a jet-thrust force towards the right for the upper part of the manifold (as depicted in FIG. 17). Similarly, the nozzles below the swivel are oriented to the right, to provide a leftward thrust to the bottom of the manifold. Thus, the manifold will be caused to rotate without any external rotating mechanism.

Other equivalent configurations for the cart can be used, by combining the several alternative configurations for the wheels, thrusters, and nozzle manifolds, that have been illustrated, or by using functionally equivalent structures that would be readily apparent to one skilled in this art. Thus, other optional designs can employ a powering means, such as a hydraulic translating cylinder to cause a left-to-right oscillating action for one or more linear nozzle manifolds. An air-oscillated or a water-oscillated cylinder could also be used to reciprocate a set of one or more linear nozzle manifolds. In this manner, instead of the fixed set of nozzles shown for example in FIG. 14, a smaller set of nozzles can be used to cover the same total path width during the passage of the cart. Such a structure would enable the use of a high-pressure pump unit which has a smaller water flow rate capacity and hence is less expensive to acquire and to operate.

Alternatively, in any of the cart embodiments, instead of a motor that is driven with hydraulic fluid, a seawater-powered or an air-powered motor can be used for the thrusters. The use of a sea-water powered motor would eliminate the hydraulic fluid pumping unit and the pair of hydraulic hoses that are required. It is also emphasized that, although the foregoing disclosure has been directed in particular to a large cart for use in servicing VLCC's, the cart can be virtually any size which is compatible with the particular ship type and size that is to be serviced. As is apparent, some of the illustrated and/or described design options are best suited for servicing certain ship sizes and types, based on operational requirements.

The foregoing description has been directed to the general operation of the underwater ship maintenance system of the invention, with particular emphasis on the design and operating details of the cart. The details relating to the optimal use of this system will now be described. Optimal usage refers to: (a) how the equipment can be best used in a hostile and varying environment, (b) how the equipment can be used rapidly and effectively on the varying hull and appendage conditions to increase ship performance, (c) when to deploy the system, to maximize the return-on-cleaning-cost expenditures for the ship owner, and (d) how to optimally deploy the system, when a limited ship-access time is available, in order to provide maximum improvement of ship performance. An outline of these various methods is shown in the flow diagram in FIG. 19. Each of these steps will now be discussed.

UNDERWATER INSPECTION OF THE SHIP

Figure 21:
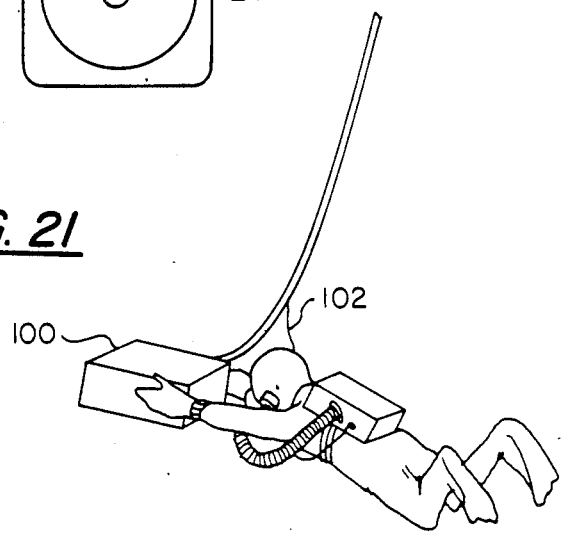
FIG. 21 is a schematic view of conventional video camera equipment, radio gear and a diver's helmet which may be utilized in the practice of the method of the invention.
Figures 20A, 20B, 20C:
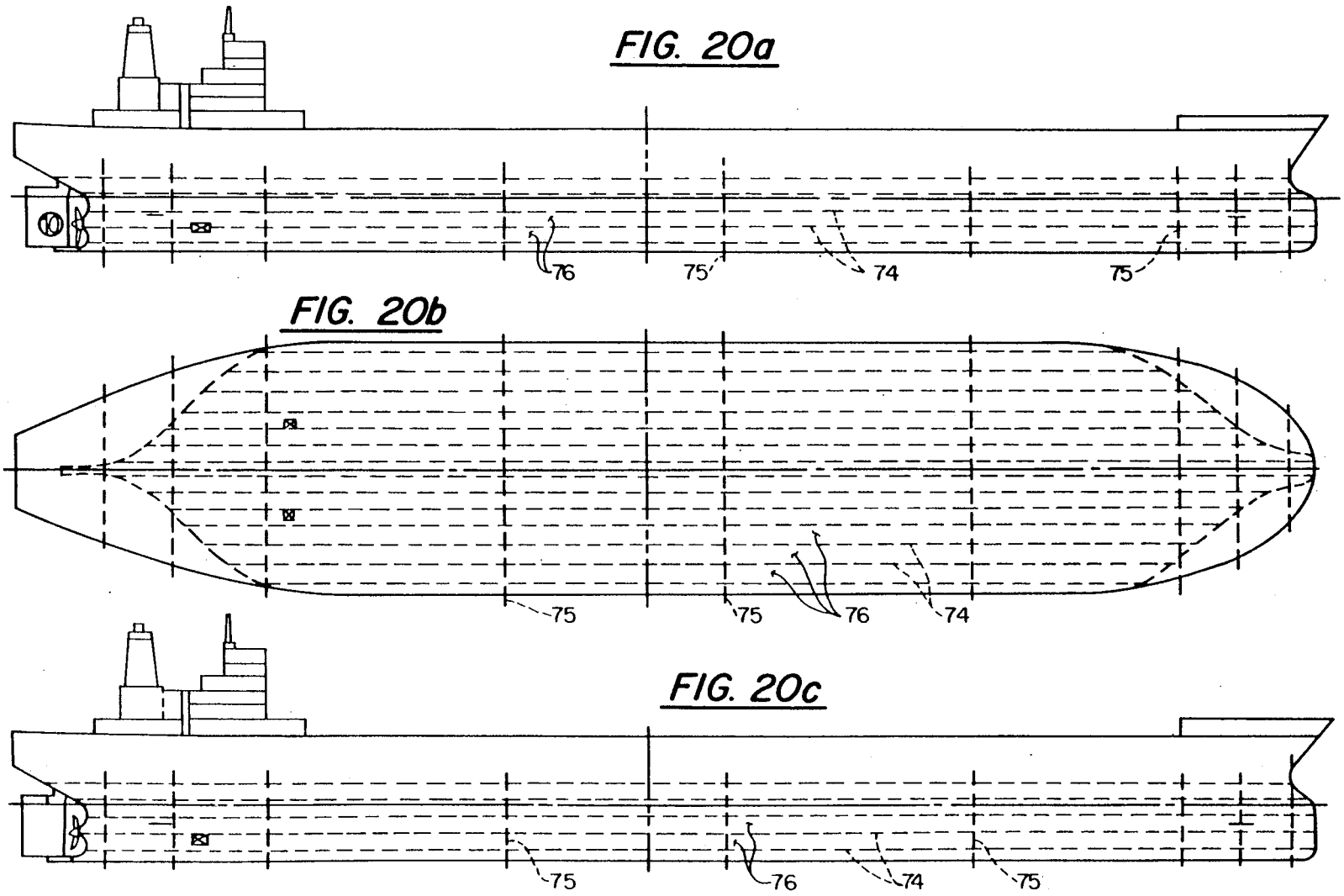
FIGS. 20*a–c* are an example of special drawings of the underwater surfaces of a ship, in accordance with this invention, for recording the status of deterioration of those surfaces.

Inspection is performed by one or more divers, each carrying an underwater television camera and lights, collectively shown as element 100 in FIG. 21. Each diver is coordinated by a control person on the surface. Both the diver and the control are in constant voice contact by hardwired radio via, for example, cable 102 in a manner known in the art, and either or both of their comments can be recorded on the video-type as the segment of hull or appendage is being examined. The control at the surface watches a video monitor and guides the diver by means of special ship drawings, as shown for example in FIGS. 20*a–c* for a VLCC. A ship drawing which shows the previous condition of the hull and appendages is used plus a fresh drawing on which notations are taken during the surveying process. At the same time, as noted above, an audio and video record is being made of the complete survey. An X-Y grid is made of the hull surface, using the butt welds as vertical markers and the seam welds 74 as the horizontal markers. In this manner, the control can route the diver to those sites which have either shown previous deterioration such as loss of effectiveness of AF coating, allowing fouling to begin; loose or flaking coating segments; and the like. In addition, the frames 75, main support plates within the ship structure, can be detected through the strakes 76, the sheets of steel that comprise the hull skin, as slight bulges which can be either felt in very opaque water or seen by the diver. These vertical frames also serve as guides for the survey.

ANALYSIS OF INSPECTION RESULTS

After the survey is completed, the notes taken on the ship drawing, plus the real-time video/audio record are used to update the drawing of the present status of that ship's underwater surfaces. Based on empirical data for that ship type, and perhaps for that specific ship, it is established what the contribution to decreased ship performance is, for various degrees of surface roughness, from various regions of the ship's hull and appendages. The results of this analysis process provide the status report for that ship at that time.

STATUS OF SUBMERGED SHIP SURFACES

This status report, which is provided to the ship's owner (or operator), tells him, based on the analysis, how much loss in ship performance that ship is experiencing in terms of: (a) decrease in the maximum achievable speed of the ship within the operating constraints for that vessel (usually steam pressure, or maximum propeller RPM), or: (b) the increase in propeller RPM which would be required in order to maintain some ship speed which is less than the maximum speed. These losses are also translated into increased expenditures for the standard working voyages that the ship is used for.

In addition, the status report provides a priority ranking of those portions of the hull and appendages which are contributing to the overall losses of ship performance, in terms of the relative portion of that overall loss which each area is contributing. In this manner, if the complete submerged area cannot be cleaned, due to either time or money constraints, then the most critical areas can be serviced on a prioritized basis. The report may advise, in the case of a severely deteriorated bottom, that only pulling the ship out of the water for a dry docking service will put the ship back into reasonable operating shape, (STATUS 2). If a STATUS 1 is indicated by the analysis, on the other hand, then the ship remains in service, and is again given an underwater inspection when it is next in port, or at a time that is indicated by the observed rate of deterioration of the submerged surfaces If, for example, STATUS 3 is indicated, then the service may be performed immediately if there is time, or it may be scheduled for the next time the ship returns.

TIME AVAILABLE FOR UNDERWATER MAINTENANCE

Figure 19:
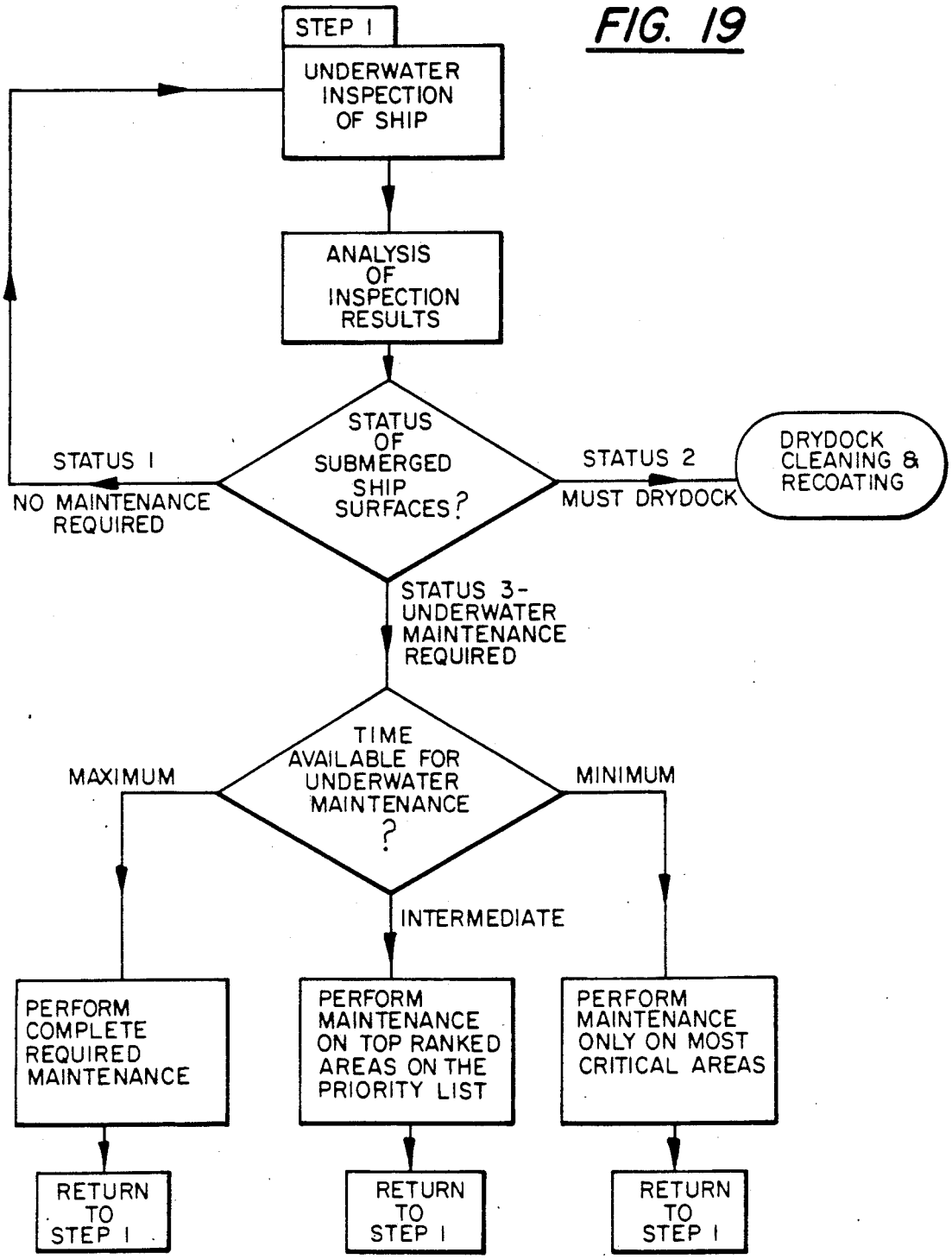
FIG. 19 is a flow diagram showing the relationship between the various steps involved in the method of the invention to optimally perform an underwater ship maintenance service.

For illustrative purposes, in FIG. 19, three examples of time available for underwater maintenance are indicated. Of course, there can be an infinite variation of this time factor, as well as any possible degree of surface deterioration and distribution of surface roughness. Indeed, it would be rare that time would be allotted (or the funds) for completion of every possible underwater maintenance task, but, in the case of a long layover between voyages this case might occur. It is more likely to be one of the other two cases illustrated in FIG. 19, namely either the INTERMEDIATE or the MINIMUM time available. In these cases, the priority ranking created from the Analysis of the Underwater Inspection is used to set the work schedule for the diving team. They begin with the most critical areas, often the propellers, and proceed down the list, working in shifts around the clock, until the ship must be put back into service.

The degree and type of fouling, and the degree and type of surface deterioration will vary greatly at various locations on the ship hull and its appendages. During the development of this invention, the procedures and methods for adapting the system's operation to deal with these varying conditions were also developed, and are thus a part of this invention. A description of these methods for dealing with varying hull conditions, in order to most rapidly perform the service, and fully clean and smooth these surfaces will now be given.

For a given rate of movement of a cleaning water jet, the degree of fouling determines the width w of the path cleaned by a particular jet at a fixed pressure and water flow rate through the nozzle. Some typical values for path width, derived from field experience with the nozzle manifold configuration of FIG. 2, rotating at 90 rpm are: for light algae: about 1 inch; for heavy algae, about $\frac{3}{8}$ inch; for a light growth of barnacles, about 1 inch; for a heavy growth of barnacles, about $\frac{1}{2}$ inch. As the cart is being moved along the hull, the diver observes the varying conditions, and is aware of the varying cleaned path widths that the cleaning/smoothing jets will achieve. The diver thus merely has to slow down or speed up the forward motion of the cart, as he encounters a new hull condition. In this manner, he insures that a full path width equal to the manifold diameter D is cleaned, with no gaps left in between the individual paths cleaned by each of the nozzles 23.

For example where $D=36$ inches, and with a set of nozzles $=12$, and where $w=\frac{1}{2}$ inch (heavy barnacles), it can be determined at what speed the cart should be driven, and what cleaning rate can be achieved. Using 90 RPM, the 12 nozzles will clean a total accumulated path of: 12 times $0.5=6$ inches in one revolution of the manifold, or in one minute: 90 times $6=540$ in./minute, or 45 ft/minute of forward speed for the cart for this fouling condition. Using the 3 ft wide total path that is being cleaned, the cleaning rate is: 45 ft/min. times 3 ft $=135$ square feet/minute, or 8,100 square feet per hour.

Similarly, for the case of : $w=1$ inch, the cart speed is: 90 ft/minute, and the cleaning rate is: 16,200 square feet/hour. These are typical rates which have been achieved in service, and which can be used in the analysis and planning process for determining where and when to conduct the underwater servicing.

The level of the effort that is completed is documented, and serves as the basis for the next inspection, as indicated in FIG. 19, by RETURN TO STEP I. In this manner, the ship maintenance service company works closely and on a continuing basis to maintain the ship in as good a condition as is possible, within the real-world constraints of time available to do the underwater maintenance work, and the amount of money that can be prudently invested in this service in terms of the performance cost savings that smooth submerged surfaces can provide.

The foregoing procedures, and the associated technical and cost analyses, were developed by usage of the system of the invention and by feed-back from the subsequent observed performance of the ships after they received this service. In this manner, the foregoing optimum usage methods were developed, which are an integral part of the present invention.

To demonstrate the effectiveness of the invention, two case histories for actual ships which received the underwater maintenance service defined herein will now be presented:

SHIP A

This was a typical VLCC, which was fully inspected in April 1989, and there was insufficient time for a complete cleaning. Using the empirically-based analysis method, the inspection results were used to predict that 46% of the total energy loss for this tanker was due to propeller roughness at that time. This led the ship owner to authorize using the time available for propeller polishing. The tanker was then placed in service, and records of actual ship performance were kept during the period: April to August, 1989, during which time the vessel was used for two voyages between the U.S. Gulf Coast and the source of crude oil at the eastern end of the Mediterranean Sea. The following table compares the predicted and the actual performance for this VLCC:

| Parameter | Nonrecoverable Frictional Losses | Losses Recoverable by Underwater Servicing |
|---|---|---|
| Percent of Total Energy Losses | Predicted: 24%<br>Actual: 26% | Predicted: 76%<br>Actual: 74% |
| Cost of Excess Fuel During a 40 day Voyage | Predicted: $8,320<br>Actual: $9,840 | Predicted: $25,960<br>Actual: $28,080 |

As shown in this table, which highlights only two of the many parameters that are involved in this analysis, the predictions for where the losses were located and the associated costs were very close to the actual experience for this VLCC during its subsequent voyages. Percentages attributable to hull versus propeller-caused losses were also very close. For instance, for the non-recoverable hull-related losses, that is, losses due to intrinsic roughnesses such as welds, plate-surface irregularities —— which cannot be serviced by the present method —— the predicted value was 15%; the actual: 18%; the comparable propeller values were: 9% for the predicted and 8% for the actual percentage of total energy loss for this tanker. From the foregoing, it is clear that the method of this invention is an accurate and reliable analysis, which allows for prudent and economical management decisions with regard to when and how much underwater servicing is to be done.

SHIP B

The experience with this ship was chosen to illustrate yet another beneficial feature of the predictive method of this invention. After the underwater inspection, the analytical method was applied, and a prediction of an excess fuel consumption due to non-recoverable frictional losses of 12.9 tons/day was made. The actual history for this VLCC, however, showed an excess fuel consumption of about 26.9 tons/day —— an apparent discrepancy of about 14 tons/day. The empirical analysis was reverified, by means of a purely analytical approach. This indicated that the additional fuel consumption was not due to non-recoverable frictional losses, but to some sort of problem in the steam plant or other portion of the mechanical powering equipment. This was reported to the owner of this tanker, and after an investigation of the power plant for this ship, several such problems were located and fixed. Thus, not only does the method of the invention serve as a guide for the efficient application of the cleaning/smoothing system of this invention, but it aids the overall maintenance of a ship by enabling the discovery of losses attributable to factors other than to the condition and configuration of the submerged hull.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

We claim:

1. A hull cleaning and smoothing cart comprising:

main frame body having a top side, a bottom side, a first end and a second end;

a plurality of wheel means mounted to said main frame body so as to extend from said bottom side thereof;

a fluid manifold mounted to said main frame body;

a plurality of high pressure fluid jet nozzles mounted to said manifold, said fluid jet nozzles directing fluid outwardly from said bottom side of said main frame body;

at least one orientable thruster assembly mounted to said main frame body, said thruster assembly having a fluid intake facing in a facing direction of said bottom side of said main frame body and a fluid exhaust facing in a facing direction of said top side;

a plurality of flexible fluid flow lines for respectively fluidly coupling said fluid manifold and each said thruster assembly to at least one source of high pressure fluid remote from said main frame body; and control means defined on said main frame body for a controlling flow of high pressure fluid to said fluid manifold and to each said thruster assembly and for controlling a tilt angle of each said thruster assembly.

2. The cart of claim 1 wherein there are two thruster assemblies, one mounted to a port side of said main frame body and one mounted to a starboard side thereof.

3. The cart of claim 1, wherein said nozzles are mounted to said fluid manifold so as to define an angle of less than 90° relative to a horizontal plane through said fluid manifold.

4. The cart of claim 3, wherein said nozzles are mounted at an angle of about 80° relative to said plane of said fluid manifold.

5. The cart of claim 1, wherein said fluid manifold is substantially circular having a plurality of spoke elements and said fluid manifold is coupled to said main frame body via a swivel coupling, said swivel coupling providing fluid communication between said main frame body and said fluid manifold.

6. The cart of claim 5, wherein said nozzles are mounted to said fluid manifold so as to define an angle of less than 90° relative to a horizontal plane through said fluid manifold so that said fluid manifold is self rotating when fluid under pressure is ejected from said nozzles.

7. The cart of claim 5, wherein said wheel means are mounted within the confines of said fluid manifold.

8. The cart of claim 1, wherein said fluid manifold is linear and is rotatably coupled to said main frame body.

9. The cart of claim 8, wherein said fluid manifold is rotatably coupled to said main frame body at a linear center thereof.

10. The cart of claim 8, wherein said nozzles are mounted to said fluid manifold so as to define an angle of less than 90° relative to a horizontal plane through said fluid manifold so that said fluid manifold is self rotating when fluid under pressure is ejected from said nozzles.

11. The cart of claim 1, wherein said control means are mounted to each of said first and second ends of said main frame body, whereby said fluid manifold and each said thruster can be controlled from either said first or said second end.

12. The cart of claim 1, wherein a single thruster assembly is defined centrally of said main frame body, said thruster assembly being gimbal mounted so that a line of thrust action can be oriented to forwardly propel the cart, to clamp the cart against a surface being cleaned and smoothed, and to steer the cart.

13. The cart of claim 1, wherein said main frame body comprises a plurality of frame elements structurally and fluidly coupled together so that main frame body is an open frame and wherein fluid communication between said flexible lines and said fluid manifold and between said flexible lines and each said thruster assembly is provided through said main frame body.

14. The cart of claim 1, wherein said main frame body includes valve means for selectively directing fluid from said flexible lines to exhaust and for selectively directing fluid from said flexible lines to at least one of said thrusters and said fluid manifold.

15. The cart of claim 1, further comprising floatation means mounted to said main frame body.

16. The cart of claim 15, wherein said floatation means comprise foam-filled buoyancy compartments defined at spaced locations about said main frame body so as to provide a net lifting force of at least about five pounds.

17. The cart of claim 15, wherein/said floatation means comprise air-filled compartments defined at spaced locations about said main frame body so as to provide a net lifting force of at least about five pounds.

18. The cart of claim 1, wherein said fluid manifold comprises a plurality of linear manifolds mounted to said main frame body.

19. The cart of claim 18, wherein said nozzle means are mounted to said linear manifolds so that the fluid flow streams of nozzles on spaced manifolds overlap.

20. The cart of claim 1, further comprising an end fluid manifold mounted to each of said first and second ends of said main frame body and each having a plurality of nozzles mounted thereto in a horizontal plane thereof so as to define a high-power fluid jet stream in said horizontal plane.

21. The cart of claim 20, wherein each said end fluid manifold is substantially circular and said nozzles on each said end fluid manifold are mounted at an angle relative to a radius thereof and said end fluid manifold is coupled via a swivel coupling to said main frame body, whereby said manifold is self-rotating.

22. The cart of claim 1, wherein said fluid manifold comprises a plurality of fluid flow manifolds mounted to each end of said main frame body.

23. The cart of claim 22, wherein said wheel means are mounted longitudinally between said fluid flow manifolds on each end of said main frame body.

24. The cart of claim 22, wherein three fluid flow manifolds are mounted to each end of said main frame body.

25. The cart of claim 24, wherein said three fluid flow manifolds comprise three circular fluid flow manifolds, each said fluid flow manifold having a plurality of nozzles mounted thereto, each said fluid flow manifold being mounted via a swivel coupling to said main frame body so as to be self-rotating.

26. The cart of claim 1, wherein there are four wheel means mounted to said main frame body, less than four of the wheel means being defined in a single plane.

27. A cart as in claim 1, wherein said flexible flow lines are coupled to said main frame body with quick connect couplers.

28. A system for cleaning a hull of a ship comprising:

a cleaning and smoothing cart including a main frame body having a top side, a bottom side, a first end and a second end; a plurality of wheel means mounted to said main frame body so as to extend from said bottom side thereof; a fluid manifold mounted to said main frame body; a plurality of high pressure fluid jet nozzles mounted to said fluid manifold, said fluid jet nozzles directing fluid outwardly from said bottom side of said main frame body; at least one orientable thruster assembly mounted to said main frame body, said thruster assembly having a fluid intake facing in a facing direction of said bottom side of said main frame body and a fluid exhaust facing in a facing direction of said top side; a plurality of flexible fluid flow lines for respectively fluidly coupling said fluid manifold and each said thruster assembly to at least one source of high pressure fluid remote from said main frame body; and control means defined on said main frame body for controlling flow of high pressure fluid to said fluid manifold and to each said thruster assembly and for controlling a tilt angle of each said thruster assembly;

and a work platform selectively receiving said cart and including means for supplying high-pressure fluid through said flexible flow lines to the nozzles and for supplying high-pressure fluid through said flexible flow lines for powering motors for rotating said thruster units; a hose reel for supplying and retrieving said flexible flow lines, said flexible flow lines including at least one high pressure fluid hose for conveying fluid between said work platform and said cart; and a subsystem for supplying air and communication means to at least one diver operating said cart.

29. A system as in claim 28, wherein said subsystem for supplying air and communication means includes air compressors, an air storage tank, radio gear and diver helmets with interconnecting air hoses and radio communication cables.

30. A system as in claim 28, wherein said means for supplying high pressure fluid includes a high pressure water pump unit to feed cleaning and smoothing water to the nozzles and wherein said system further comprises a feed-water subsystem for supplying clean sea water to said high pressure water pump, said feed-water subsystem including a centrifugal feed-water pump, a submerged suction basket, filter units for filtering fluid collected from the sea and means for delivering the filtered sea water to said high pressure pump.

31. A system as in claim 30, wherein said high pressure water pump unit feeds high pressure fluid to said at least one orientable thruster assembly for powering said thruster motors.

32. A system as in claim 30, wherein said means for supplying high-pressure fluid further comprises a hydraulic pump unit for providing pressurized hydraulic fluid for powering said thruster motors, said flexible flow lines including one high pressure water hose and two hydraulic hoses for delivering hydraulic fluid to and returning hydraulic fluid from said cart.

33. A system as in claim 28, further comprising means for lifting said cart from said work platform and transferring said cart into water adjacent to said work platform for deployment.

34. A system as in claim 28, wherein said work platform is provided on the deck of a boat.

35. A method for maintaining a ship hull comprising:

providing underwater video camera equipment;

periodically surveying the submerged hull of the ship with said video camera equipment controlled by a diver who is in voice communication with an above-water controller;

providing a drawing of the hull of the ship:

recording the condition of various portions of the ship hull on said drawing of the hull of the ship;

determining the decrease in performance attributable to each submerged portion of the hull;

determining whether no maintenance is required, the ship must be dry docked, or interim underwater maintenance would be desireable;

prioritizing areas to be cleaned in accordance with projected improved performance, available time, and cost of cleaning if interim underwater maintenance is indicated;

performing required maintenance on designated areas in said order of priority; and returning the ship to service.

36. A method as in claim 35, wherein said step of determining the decrease in performance attributable to each submerged portion of the hull includes determining a percentage of decrease in performance attributable to nonrecoverable hull-structure-related frictional losses and determining a percentage of decrease in performance attributable to recoverable surface growth and deterioration frictional losses.

37. A method as in claim 35, further comprising determining the decrease in performance attributable to factors other than submerged hull configuration and condition.

38. A method as in claim 35, wherein said steps of surveying and recording include locating horizontal and vertical welds and bulges in the strakes of the hull and using said welds and bulges as a guide for determining which portions of the hull are being surveyed and as a guide for recording the condition thereof.

* * * * *